US005105755A

United States Patent [19]

Davidson

[11] Patent Number: 5,105,755

[45] Date of Patent: Apr. 21, 1992

[54] PONTOON BOAT GATE WITH SAFETY SWITCH

[75] Inventor: Samuel L. Davidson, Monroe, La.

[73] Assignee: Mastercrafters Corporation, Winnsboro, La.

[21] Appl. No.: 544,661

[22] Filed: Jun. 27, 1990

[51] Int. Cl.[5] ..... B63B 19/00

[52] U.S. Cl. ..... 114/343; 114/120; 440/1

[58] Field of Search ..... 180/286; 114/117, 120, 114/343; 440/1, 84, 85; 49/404, 421, 425, 449; 123/198 D; 252/246

[56] References Cited

U.S. PATENT DOCUMENTS

| | | | |
|---|---|---|---|
| 1,057,522 | 4/1913 | Brace | 292/246 |
| 1,364,934 | 1/1921 | Johnson | 49/425 |
| 1,762,451 | 6/1930 | Murphy | 114/61 |
| 2,182,426 | 12/1939 | Courcier, Sr. | 180/286 |
| 3,630,163 | 12/1971 | Williams | 114/61 |
| 3,807,338 | 4/1974 | Shader | 114/60 |
| 4,539,452 | 9/1985 | Draxter et al. | 200/334 |
| 4,582,493 | 4/1986 | Toyoharai et al. | 440/84 |

FOREIGN PATENT DOCUMENTS

| | | | |
|---|---|---|---|
| 623223 | 6/1927 | France | 49/404 |

*Primary Examiner*—Sherman Basinger
*Attorney, Agent, or Firm*—Fleit, Jacobson, Cohn, Price, Holman & Stern

[57] ABSTRACT

A boat including a deck equipped with peripherally upwardly projecting components surrounding a passenger area is provided including passageways from the passenger area between adjacent components leading to the deck periphery. Openable and closable gates are provided to control passenger movement through the passageways and the boat includes a marine propulsion system including an electrical control circuit therefore equipped with normally opened control switches operatively associated with the gates in a manner closing the switches when the gates are closed, to thereby enable operation of the marine propulsion system only when all gates are closed.

3 Claims, 2 Drawing Sheets

PONTOON BOAT GATE WITH SAFETY SWITCH

BACKGROUND OF THE INVENTION

1. Field of the Invention

This invention relates to a pontoon boat of the type including a substantially horizontal deck and a plurality of horizontally spaced apart above deck components projecting upwardly from the deck to define passageways between the horizontally spaced apart components. Such passageways usually open immediately outward of marginal portions of the deck and, for safety reasons, are provided with gates in order to prevent accidental movement of any passengers through the passageways and into the water while the pontoon boat is underway. In addition each of the gates includes a control switch operatively associated therewith and serially connected within the ignition circuit of the associated marine engine and each of the switches is "open" when the associated gate is moved even slightly from the closed position thereof toward the open position thereof. In this manner, operation of the marine propulsion engine of the pontoon boat may not occur unless all of the gates are in the fully closed positions, an emergency bypass switch under the control of the helm being provided to override the control of the gate switches in an emergency or otherwise necessary condition.

2. DESCRIPTION OF RELATED ART

Various different forms of gates heretofore have been provided including electric circuit controlling switches operatively associated therewith. In addition, it is also known to provide gates, in one form or another, for above deck passageways between horizontally spaced apart boat components projecting upward from a deck surface. However, I am unaware of any boat passageway gate having a control switch operatively associated therewith in a manner such that an associated marine propulsion system may be rendered operative only when the gate is in the fully closed position and is automatically rendered inoperative when the associated gate is shifted a predetermined amount from the fully closed position thereof toward the open position.

SUMMARY OF THE INVENTION

This invention relates to a gate for an above deck passageway and which is shiftable between open and closed positions enabling and preventing, respectively, passage through the associated passageway. In addition, the gate is operatively associated with a control switch serially connected within a marine propulsion system control circuit in a manner such that the associated marine propulsion system may not be rendered operable (with one exception) unless the gate is in the fully closed position thereof.

The exception resides in the provision of a bypass circuit having an override switch operatively associated therewith whereby the gate associated switch may be overridden and the associated marine propulsion system may be rendered operative by actuation of the override switch, which switch is disposed immediately adjacent the helm of the associated boat.

The main object of this invention is to provide a pontoon boat equipped with openable and closable gates at above deck passageways opening outwardly toward outer margins of the deck of an pontoon boat and with each of the gates including a control switch operatively associated therewith serially connected within a control circuit for the associated marine propulsion system, whereby the marine propulsion system may not be rendered operative unless all gates are in the fully closed positions thereof.

Another object of this invention, in accordance with the immediately preceding object is to provide a marine passageway gate of simple construction and which may be readily shifted between the open and closed positions thereof as well as locked in the closed position.

Still another object of this invention is to provide a marine passageway gate incorporating slidable bars arranged in a framed system with a guide wheel on the outer end of the gate to thereby render the gate reciprocating rather than swingable so as to maximize space utilization.

Another important object of this invention is to provide a marine passageway gate incorporating a lock construction which may be readily used to releasably lock the gate in a closed position.

Yet another object of this invention is to provide a marine passageway gate including mounting components therefore which may be readily installed on two horizontally opposed upstanding surfaces defining the side boundaries of a passageway extending therebetween.

A final object of this invention to be specifically enumerated herein is to provide a marine passageway gate which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
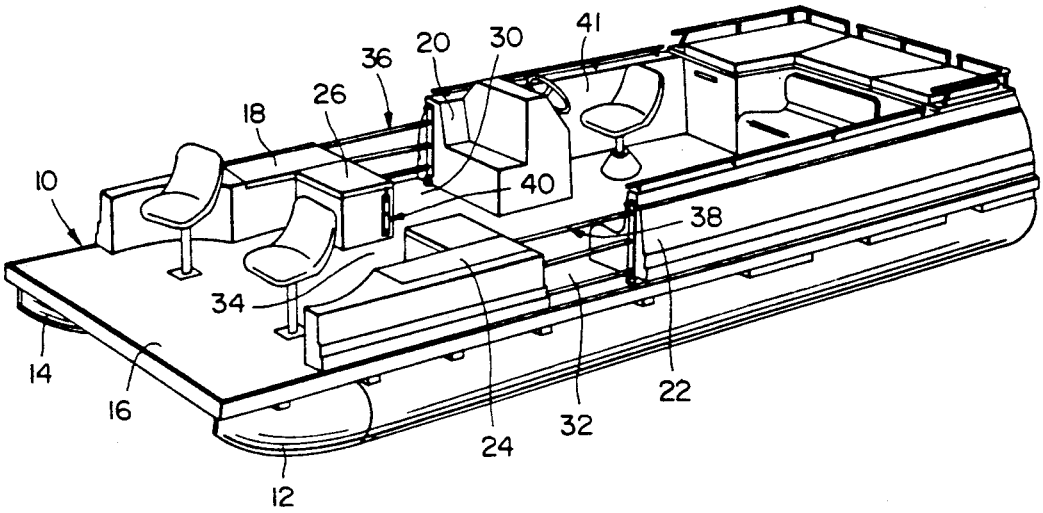
FIG. 1 is a perspective view of a pontoon boat incorporating three passageways between pairs of horizontally spaced apart components projecting upwardly from the deck of the pontoon boat and with one of the gates in an open position and the other two gates in closed positions.
Figure 3:
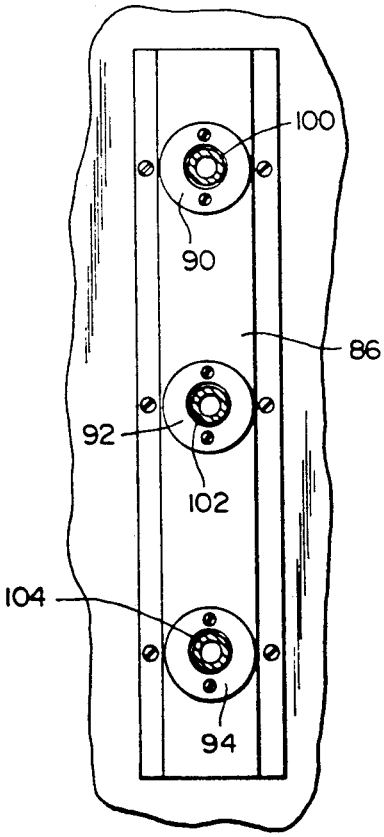
FIG. 3 is a vertical sectional view taken substantially upon the plane indicated by the section line 3—3 of FIG. 2.

Referring now more specifically to the drawings, the numeral 10 generally designates a typical form of pontoon boat including a pair of opposite side pontoons 12 and 14 and a generally rectangular deck 16 supported therefrom. The deck 16 includes a plurality of hollow, upwardly projecting above deck components 18, 20, 22, 24 and 26. The components 18 and 20 are horizontally spaced apart and define a passageway 30 therebetween, the components 22 and 24 are horizontally spaced apart and define a passageway 32 therebetween and the components 24 and 26 are horizontally spaced apart and define a passageway 34 therebetween, the passageways 30, 32 and 34 having horizontally shiftable gates 36, 38 and 40, respectively, operatively associated therewith.

Figure 4:
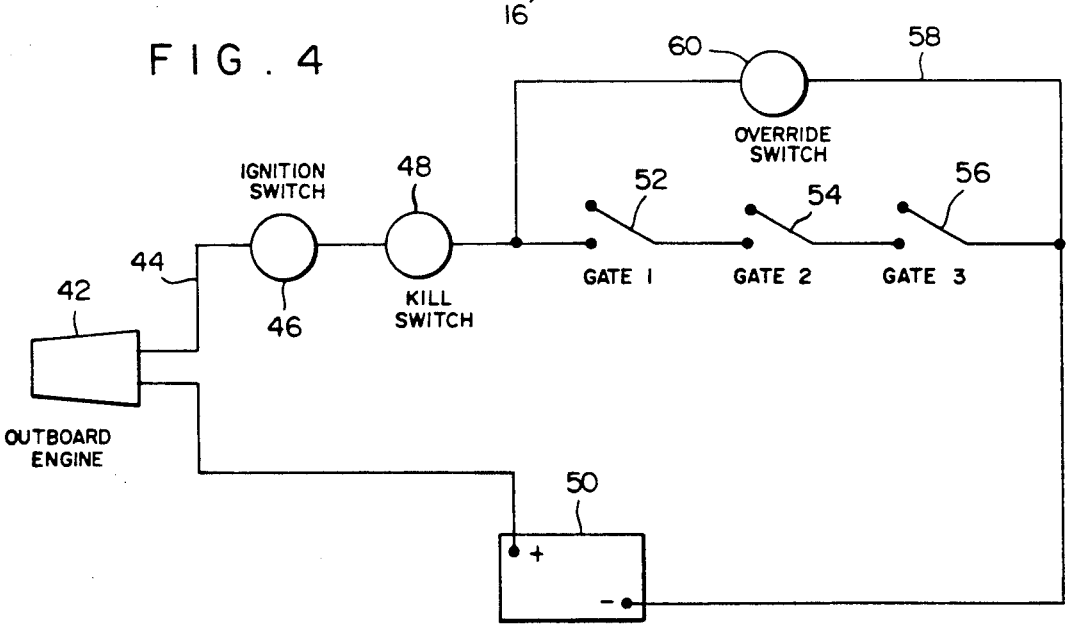
FIG. 4 is a diagrammatic view illustrating the manner in which all three of the passageway gates have control switches operatively associated therewith serially connected within the ignition circuit of the outboard engine of the pontoon boat and with the ignition circuit including a bypass circuit for bypassing the gate actuated switches; an FIG. 5 is an enlarged fragmentary vertical sectional view similar to FIG. 2 and illustrating a slightly modified form of the invention.

The pontoon boat 10 includes a helm position 40 and a marine propulsion system comprising an outboard engine 42 controlled from the helm position 40. The outboard engine 42, shown only schematically in FIG. 4, but in practice mounted at the transom of the pontoon boat 10, includes a control (ignition) circuit 44 including the usual key operated ignition switch 46 and safety kill switch 48 serially connected therein. The ignition circuit 44 is electrically connected to a suitable source 50 of electrical potential and further has three switches 52, 54 and 56 serially connected therein. A bypass circuit 58 is provided and is connected in parallel to the circuit 44 bypassing the switches 52, 54 and 56, the bypass circuit 58 including a manual override switch 60 which may be readily actuated from the helm position 40. Of course, the ignition 46 and kill switch 48 also are disposed at the helm position 40.

Considering now the gates 36, 38 and 40, only the gate 38 will be specifically described, inasmuch as all the gates are similar.

The gate 38 is disposed between the components 22 and 24, each of which components are hollow.

In the embodiment shown components 22 and 24 are constructed of fiberglass and the component 22 includes an upstanding wall 64 opposing an upstanding wall 66 of the component 24. The wall 64 has an opening 68 formed therein and the wall 66 has three vertically spaced openings 70, 72 and 74 formed therethrough. In addition, the interior of the component 24 includes a fiberglass partition 76 spaced inward from the wall 66 and through which guide sleeves 80, 82 and 84 are secured in axial registry with the openings 70, 72 and 74.

The outer surface of the wall 66 includes an open sided housing 86 secured thereover in a vertically extending zone in which the openings 70, 72 and 74 are formed and the housing 86 includes guide sleeves 90, 92, and 94 secured therethrough in registry with the openings 70, 72, and 74.

The gate 38 includes an elongated vertical member 96 having a support wheel 98 journaled from its lower end and three vertically spaced, horizontal elongated members 100, 102, and 104 including one set of corresponding ends secured through openings provided therefore in the vertical member 96. The vertical member 96 includes an upper end portion 106 extending above the uppermost horizontal member 100 and the members 100, 102, and 104 are guidingly received through the guide sleeves 90, 92, and 94; the openings 70, 72 and 74 and the guide sleeves 80, 82 and 84. Furthermore, the support wheel 98 is rollingly engaged with the deck 16 and thereby supports the extendable and retractable end of the gate 38.

The vertical side wall 64 includes an open sided housing 108 secured thereto corresponding to the housing 86 and including guide sleeves 110, 112 and 114 corresponding to the sleeves 90, 92 and 94 secured thereto, the guide sleeve 110 being registered with the opening 68 formed in the vertical side wall 64.

Figure 2:
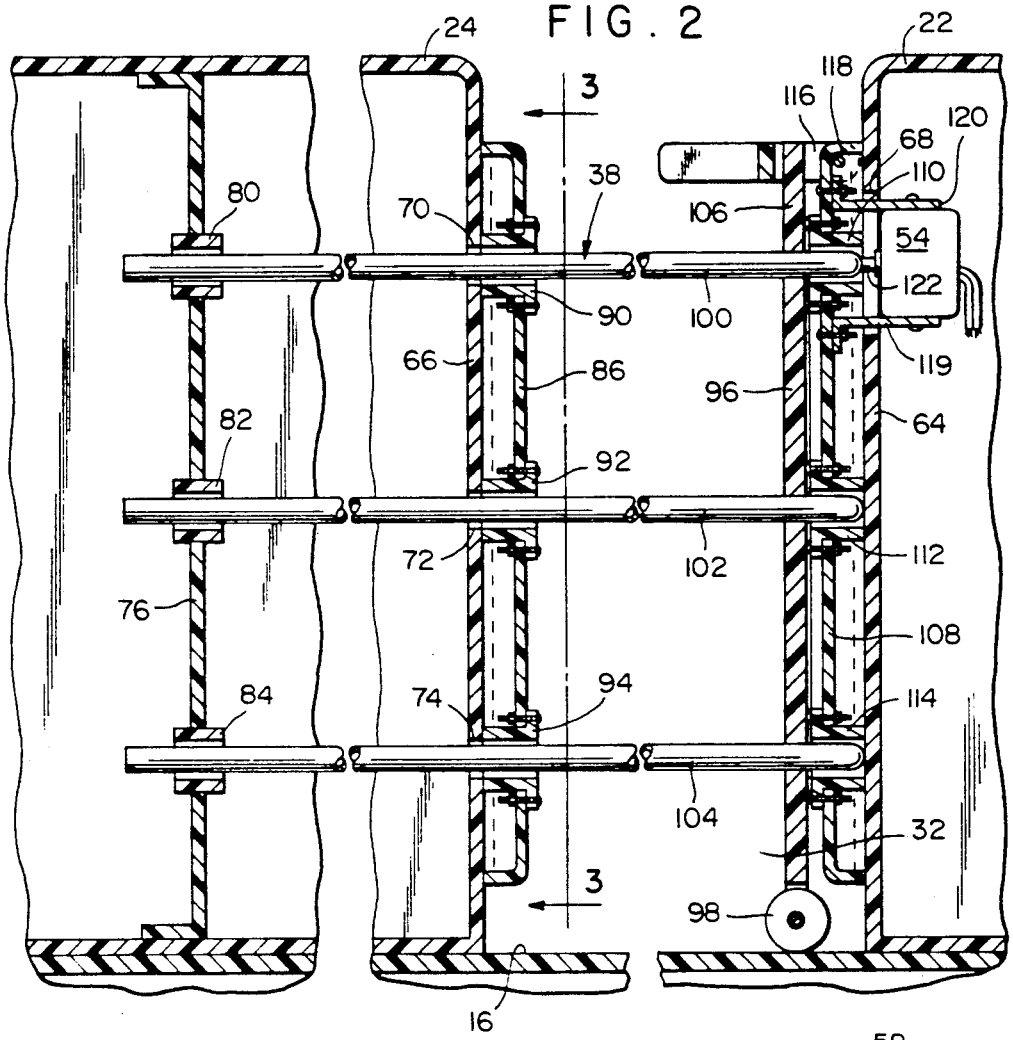
FIG. 2 is an enlarged fragmentary vertical sectional view illustrating the external and internal components of the gate and with the gate in a closed position.

The one set of corresponding ends of the horizontal members 100, 102 and 104 which extend through the vertical member 106 are substantially fully received within the guide sleeves 110, 112 and 114 when the gate 38 is in the fully closed position and the upper end of the housing 108 includes a bail-type latch 116 pivotally supported therefrom as at 118 and swingable between an upstanding inoperative position and a horizontal operative position such as that illustrated in FIG. 2 engaged over the upper end portion 106 to thereby prevent retraction of the vertical member 106 away from the housing 108.

The housing 108 additionally includes a pair of mounting brackets 119 and 120 supported therefrom which project through the opening 68 and support the switch 54 therefrom, the switch 54 including a plunger-type actuator 122 for closing the switch 54 when inwardly depressed by the horizontal member 100 as the gate 38 is shifted to the closed position thereof illustrated in FIG. 2. The switches 52, 54 and 56 are normally open and each includes a plunger-type actuator such as the actuator 122 for inward displacement by engagement of the corresponding horizontal member 100 when the associated gate is in the fully closed position.

The gates 36, 38 and 40 control the passageways, 30, 32 and 34 (as for example to prevent small children from moving through the passageways toward the outer periphery of the boat 10) and if either one of the gates 36, 38 and 40 is not fully closed, the corresponding switch will be opened to thereby open the ignition circuit 44 (assuming that the override switch 60 is open). When the ignition circuit 44 is open, the outboard engine 42 may not be operated.

In an emergency situation, the override switch 60 at the control of the operator of the helm position 40 may be closed to actuate the ignition circuit 44 even if one or all of the gates 36, 38 and 40 are open.

Figure 5:
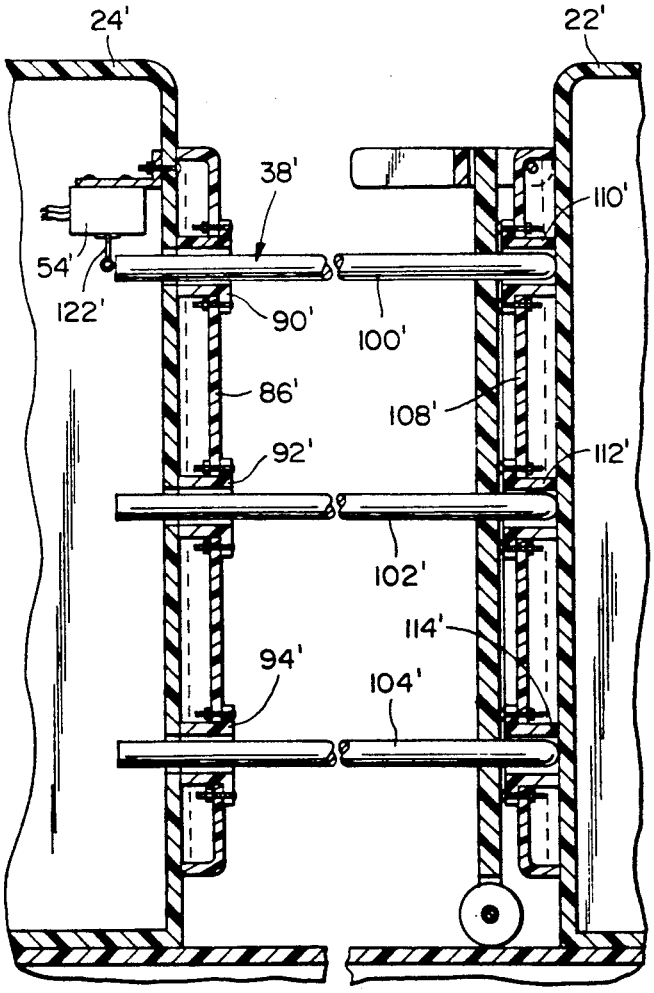

With attention now invited more specifically to FIG. 5 of the drawings, there may be seen a modified form of gate 38' between components 22' and 24'. The gate 38' is substantially similar to the gate 38, but the component 24' does not include the equivalent of the partition 76 and guide sleeves 80, 82 and 84 and the component 22' does not include an opening corresponding to the opening 68 or a switch corresponding to the switch 54. Rather, the gate 38' has its upper horizontal member 100' disposed in operative association with a switch 54' including a pivoted actuator 122' mounted within the interior of the component 24'. Otherwise, the gate 38' is structurally and operationally identical to the gate 38 and the various components thereof are referred to by prime reference numerals corresponding to the reference numerals appearing in FIG. 2.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a boat including a deck surface upwardly from which a pair of horizontally spaced, hollow above deck components project to define a passageway therebetween, a horizontally shiftable gate for said passageway, said gate including a plurality of vertically spaced horizontal bars having corresponding first and second sets of opposites ends, a vertical gate bar supported adjacent and having said first set of ends anchored relative thereto with said first set of ends projecting outwardly beyond the side of said vertical gate bar remote from said second set of ends, said components each including an upstanding wall opposing the other component, the upstanding wall of one of said components defining a set of vertically spaced horizontal openings therethrough opening into the interior of said one component, said components each including means defining a set of vertically spaced horizontal guide sleeves outwardly of the corresponding upstanding wall, said means defining said vertically spaced horizontal guide sleeves including a vertically extending open sided housing secured over, extending along and opening toward each upstanding wall, said housings each including a set of vertically spaced sleeves opening therethrough defining said guide sleeves with corresponding guide sleeves of said housings horizontally aligned, the guide sleeves of the housing secured over the upstanding wall of said one component being registered with the corresponding openings and said bars being guidingly received through the guide sleeves of the housing secured over said one component and through said corresponding openings for reciprocal movement of said gate between open and closed positions with said vertical bar adjacent said one component housing and the other component housing, respectively, said other component housing and said vertical gate bar including coacting means operative to releasably lock said vertical gate bar in position adjacent said other component housing and against movement toward said one component housing, said other component upstanding wall and the corresponding sleeves defining a plurality of vertically spaced, horizontally outwardly opening recesses in which said first set of ends are received when said gate is in said closed position.

2. The boat of claim 1 including support wheel means journaled from the lower end of said vertical gate bar and rollingly engaged with said deck surface.

3. The boat of claim 1 wherein said vertical gate bar includes an upper end portion projecting upwardly above the uppermost horizontal bar, said coacting means including said upper end portion and a bail-type latch pivotally mounted from said housing of said other component for oscillation about an horizontal axis between an inactive upstanding position and an active horizontal position downwardly embracingly engaged over said upper end portion.

* * * * *